US005585591A

United States Patent [19]

Waldock

[11] Patent Number: 5,585,591

[45] Date of Patent: Dec. 17, 1996

[54] ELECTRIC DETONATOR AND LEAD CONNECTOR ASSEMBLY

[75] Inventor: Kevin H. Waldock, Runaway Bay, Australia

[73] Assignee: Clipmate Corp., Oklahoma City, Okla.

[21] Appl. No.: 587,610

[22] Filed: Jan. 17, 1996

Related U.S. Application Data

[60] Continuation of Ser. No. 316,702, Sep. 30, 1994, abandoned, which is a division of Ser. No. 17,541, Feb. 16, 1993, Pat. No. 5,392,712.

[51] Int. Cl.[6] ..... F42B 39/30

[52] U.S. Cl. ..... 102/202.12; 102/275.12; 206/3; 206/564; 206/499

[58] Field of Search ..... 102/202.12, 202.14, 102/202.9, 275.12; 206/3, 564, 317, 327, 499

[56] References Cited

U.S. PATENT DOCUMENTS

| | | | |
|---|---|---|---|
| 1,509,123 | 9/1924 | Binder | 206/446 |
| 1,562,114 | 11/1925 | Micheli | 206/3 |
| 2,062,189 | 11/1936 | Olin et al. | 102/202.12 |
| 2,228,493 | 1/1941 | Will | 206/564 |
| 2,993,441 | 7/1961 | Griffith et al. | 102/322 |
| 3,117,519 | 1/1964 | Hamilton et al. | 102/202.8 |
| 3,446,047 | 5/1969 | Cleland | 102/202.5 |
| 3,589,511 | 6/1971 | Britt | 206/564 |
| 3,923,152 | 12/1975 | Minneman | 206/3 |
| 3,931,763 | 1/1976 | Bluhm | 102/202.12 |
| 4,425,849 | 1/1984 | Jorgenson | 102/275.12 |
| 4,637,312 | 1/1987 | Adams et al. | 102/275.12 |
| 4,807,747 | 2/1989 | Hadtke | 206/327 |
| 4,817,787 | 4/1989 | Owen | 206/3 |
| 4,952,167 | 8/1990 | Hertelendy | 439/395 |

FOREIGN PATENT DOCUMENTS

| | | | |
|---|---|---|---|
| 0164941 | 12/1985 | European Pat. Off. . | |
| 2655721 | 6/1978 | Germany | 206/3 |
| 15703 | of 1895 | United Kingdom | 206/3 |
| 735407 | 8/1955 | United Kingdom . | |
| 841790 | 7/1960 | United Kingdom | 102/202.5 |
| 930607 | 7/1963 | United Kingdom | 206/3 |
| 2191566 | 12/1987 | United Kingdom | 102/202.5 |

*Primary Examiner*—Stephen M. Johnson
*Attorney, Agent, or Firm*—McKinney, Stringer & Webster

[57] ABSTRACT

A detonator assembly wherein the electrical leads are attached to an electrical connector which maintains the ends of the leads in non-conductive, waterproof condition and which permits the leads to be spliced to another pair of electric leads without any splicing tools. The length of the electrical leads is selected to permit the assembly to be inserted in a booster charge so that the electrical connector is contained entirely within the throughbore in the booster charge. Packaging for such detonator assemblies includes at least one tray integrally formed of fire retardant material. The detonator assemblies fit snugly in parallel elongate recesses in the top of the tray so that when the tray is tipped or inverted the detonators will remain in position. The detonator assemblies are arranged in alternating fashion so that the detonator ends of adjacent assemblies are at opposite sides of the tray. Further, the recesses in each tray are spaced apart to maintain the detonators about one inch apart, and each tray is about one-inch thick so that detonators in adjacent stacked trays also are at least an inch apart.

22 Claims, 2 Drawing Sheets

ELECTRIC DETONATOR AND LEAD CONNECTOR ASSEMBLY

This applications is a continuation of application Ser. No. 08/316,702 filed on Sep. 30, 1994, entitled ELECTRIC DETONATOR AND LEAD CONNECTOR ASSEMBLY, now abandoned which is a divisional of application Ser. No. 08/017,541, filed Feb. 16, 1993, now U.S. Pat. No. 5,392,712, issued Feb. 25, 1995, entitled ELECTRIC DETONATOR AND LEAD CONNECTOR ASSEMBLY, and the entire contents of these prior applications are incorporated by reference.

FIELD OF THE INVENTION

The present invention relates generally to detonation devices for explosives and in particular to electric detonation devices coupled with electrical lead connectors.

SUMMARY OF THE INVENTION

The present invention is directed to a detonator assembly for use with a booster charge. The assembly includes an electrical detonator and two electrical leads of equal length. One end of each lead is connected to the electrical detonator, and the other end of each lead is connected to an electrical connector. The connector is characterized as capable of maintaining the ends of the two electrical leads in non-conductive condition. The length of the leads is selected so that when the detonator assembly and the booster charge are assembled, the electrical connector will be contained entirely within the throughbore of the booster charge.

The present invention further includes packaging for a plurality of detonator assemblies. The packaging includes at least one tray. The top of the tray defines a plurality of parallel elongate recesses, and each such recess is shaped to grippingly receive a single detonator assembly.

The present invention further comprises a packaging tray with a plurality of parallel elongate recesses containing the detonator assemblies in alternating fashion so that the detonator ends of adjacent assemblies are at opposite sides of the tray.

Still further, the present invention includes a packaging tray having a plurality of parallel elongate recesses containing the detonator assemblies and which are spaced apart to maintain the detonator portions of the detonator assemblies at least about one inch apart.

The present invention also contemplates packaging comprising a plurality of stacked trays. Each of the stacked trays has a plurality of parallel elongate recesses, each of which contains a detonator assembly and each of which is about one inch thick so that detonator assemblies in adjacent trays are maintained at least about one inch apart.

Finally, the present invention includes a method for assembling an electronic detonator and a booster charge. First, there is selected a booster charge having a body with a first end and a second end, a blind bore in one end for receiving an electronic detonator, and a throughbore spaced a distance from the blind bore and extending from the first end to the second end.

A detonator assembly also is selected. The detonator assembly comprises an electronic detonator having a first end and a second end, an electrical connector having a first end and a second end, and a pair of electrical leads connecting the first end of the detonator and the first end of the connector, the leads having a length slightly greater than the distance between the blind bore and the throughbore in the booster charge.

A length of leg wire is selected. The leg wire comprises a pair of electrical leads and has a first end and a second end.

The first end of the selected length of leg wire is threaded through the throughbore in the body of the booster charge so that the first end of the selected length of leg wire extends a distance out of the throughbore from the first end of the body of the booster charge. Then, the first end of the selected length of leg wire is connected to the second end of the electrical connector of the detonator assembly. Then, the detonator is inserted, second end first, into the blind bore in the first end of the booster charge, and the leg wire is pulled tautly through the throughbore.

DETAILED DESCRIPTION OF THE PREFERRED EMBODIMENTS

Figure 1:
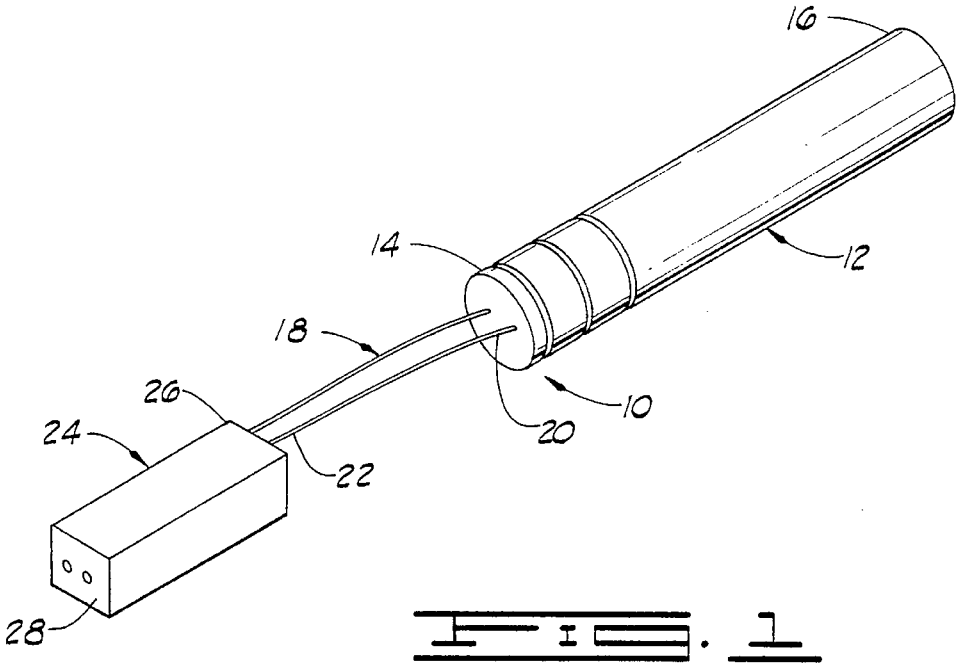
FIG. 1 is a perspective view of a detonator assembly in accordance with the present invention.

Electric and electronic detonators typically comprise a small charge of explosive contained in a metal casing. The detonators are equipped with lengths of twin electrical leads referred to as "leg wire." Detonators are commercially available with leg wires of assorted lengths, such as 16 feet, 24 feet, 50 feet, and so forth. Detonators are also manufactured with different delay periods, such as 24 milliseconds, 50 milliseconds, and so forth. Given the specific leg wire length and delay periods of conventional detonator products, detailed planning and the purchase of the correct number of specific detonator products is required for maximum efficiency.

To utilize a detonator which has the desired delay period but which has an inadequate length of leg wire, an additional length of leg wire may be attached by splicing it to the ends of the leg wire on the detonator. Industry standards presently require that the ends of the leg wires on detonators be shunted by stripping the insulation jacket for a few inches, twisting the bare conductive core portions of the leads together, and covering the stripped portions of the wire with a non-conductive protective sleeve. This is done to reduce the likelihood that a stray electrical charge will activate the detonator. To splice on additional leg wire, the ends of the extra leg wire are stripped and connected to the stripped ends of the leg wire from the detonator by twisting the ends together or using a crimping tool. While effective, this splicing procedure is time consuming and inconvenient at the blast site.

The present invention provides a detonator assembly comprising a conventional detonator with a relatively short length of leg wire attached. The free ends of the leg wire are attached to an electrical connector which substitutes for the shunt. This electrical connector maintains the ends in waterproof, non-conductive condition and allows the leg wire to be spliced with additional leg wire without the use of stripping or crimping tools.

The detonator assembly of this invention is designed to be used with a conventional booster charge. To this end, the leg wire is relatively short so that when the assembly is emplaced in the booster, the electrical connecter will be contained within the throughbore of the booster. This protects the connector from damage while the booster charge is being lowered into the blast hole.

Also, it will be appreciated that the detonator assembly of this invention will in most instances reduce the cost of materials for a blast job. This is because the price of conventional detonators includes the cost of the leg wire at a price substantially higher than the cost of leg wire when bought in bulk. Furthermore, the detonator assembly of this invention permits the operator to purchase detonators simply by delay periods, rather than the delay period and the leg wire length. This simplifies the planning and execution of a blast job, as all detonators with equal delay periods are interchangeable.

Due to the short leg wire lengths, the detonator assemblies can be packaged in multiples. By employing the packaging of this invention, multiple detonators can be safely shipped and stored. The packaging, which includes multiple trays, maintains all detonators in a package at least one inch apart. Also, in accordance with the present invention, the detonator ends of the assemblies are arranged in alternating fashion so that the detonators of adjacent assemblies are at opposite ends of the package. Thus, in the event of an accidental detonation, the burst from the exploding detonator will be aimed away from the other detonators in the package. These and other advantages of the present invention will be apparent from the following description of the preferred embodiments.

Turning now to the drawings in general and to FIG. 1 in particular, there is shown therein a detonator assembly constructed in accordance with the present invention and designated generally by the reference numeral 10. The detonator assembly comprises an electronic detonator 12. Conventional detonators are suitable for use in this invention. The detonator 12 has a first end 14 and a second end 16.

The assembly 10 further comprises a pair of electrical leads 18 which are of about equal length and which have first ends 20 and second ends 22. The first ends 20 are connected to the first end 14 of the detonator 12. The leads 18 preferably are conventional electronic wires, which comprise a conductive core and an insulating jacket.

The assembly 10 still further comprises an electrical connector 24 having a first end 26 and a second end 28. The first end 26 of the connector 24 is connected to the second ends 22 of the two electrical leads 18. The electrical connector 24 is characterized as capable of maintaining the seconds ends 22 of the two electrical leads 18 in non-conductive and also preferably waterproof condition. The connector 24 also preferably permits a waterproof, high tensile strength splicing of the two electrical leads 18 with another pair of similar electrical leads without the use of splicing tools.

A preferred electrical connector for this purpose is marketed under the name ClipMate™ by ClipMate Corporation (Oklahoma City, Okla.). This electrical connector is described in detail in U.S. Pat. No. 4,952,167, issued Aug. 20, 1990, and the content of this patent is incorporated herein by reference.

Figure 2:
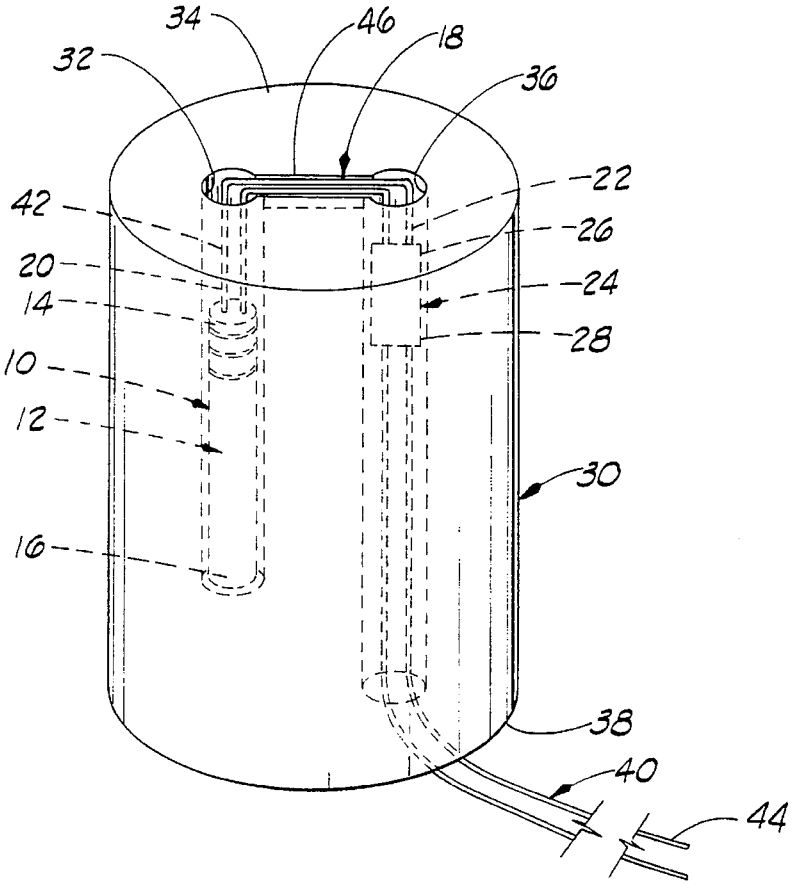
FIG. 2 is a side elevational view illustrating the use of a detonator assembly in a booster charge.

With reference now to FIG. 2, the use of the detonator assembly 10 now will be described. A conventional booster charge 30 is generally cylindrical in shape. A first blind bore 32 extends from the first end 34 a distance into the booster 30. A second throughbore 36 extends from the first end 34 through the length of the booster 30 to the opposite or second end 38.

In accordance with the method of the present invention, a length of conventional leg wire 40 is selected. The leg wire 40 comprises a pair of electrical leads and has a first end 42 and a second end 44. The leg wire 40 is threaded through the throughbore 36 so that the first end 42 of the leg wire 40 extends a distance out of the throughbore 36 at the first end 34 of the booster charge 30.

Next, the first end 42 of the leg wire 40 is connected to the second end 28 of the connector 24 of the assembly 10 in the manner taught in U.S. Pat. No. 4,952,167. The detonator 12 of the assembly 10 then is inserted into the blind bore 32, and the leg wire 40 is pulled taught through the throughbore 36 so that the connector 24 is protected inside the throughbore. Thus assembled, the booster 30 can be dropped down into the blast hole (not shown) or otherwise positioned in a known manner so as to detonate the primary charge.

Now it will be appreciated that the electrical connector 24 should be sized to fit easily inside the throughbore 36 in booster charge 30. Further, it now will be understood that the length of the twin leads 18 in the assembly 10 between the connector 24 and the detonator 12 should be long enough to traverse comfortably the distance between the bores 32 and 36 on the first end 34 of the booster charge 30.

It is also preferable, however, that the length of the leads 18 be shorter than the sum of the distance between the bores 32 and 36 and the length of the throughbore 36. In this way, when the assembly 10 is threaded through the booster 30, the connector 24 will be positioned well inside the booster. This will protect the connector 24 from damage as the booster 30 is lowered into the blast hole. To this end, the leads 18 preferably are from about one-half inch to about 12 inches long, more preferably from about one inch to about three inches long, and most preferably about two inches long.

It is also desirable to provide a groove 46 in the first end 34 of the booster 30 which extends from the mouth of the blind bore 32 to the mouth of the throughbore 36. When the leg wire 40 is pulled tautly through the throughbore 36 to position the detonator inside the throughbore, the middle portion of the twin electrical leads 18 will nest in the groove 46. This stabilizes the assembled booster 30 and protects the leads 18 from injury as the booster is lowered into a blast hole or other location.

Figure 3:
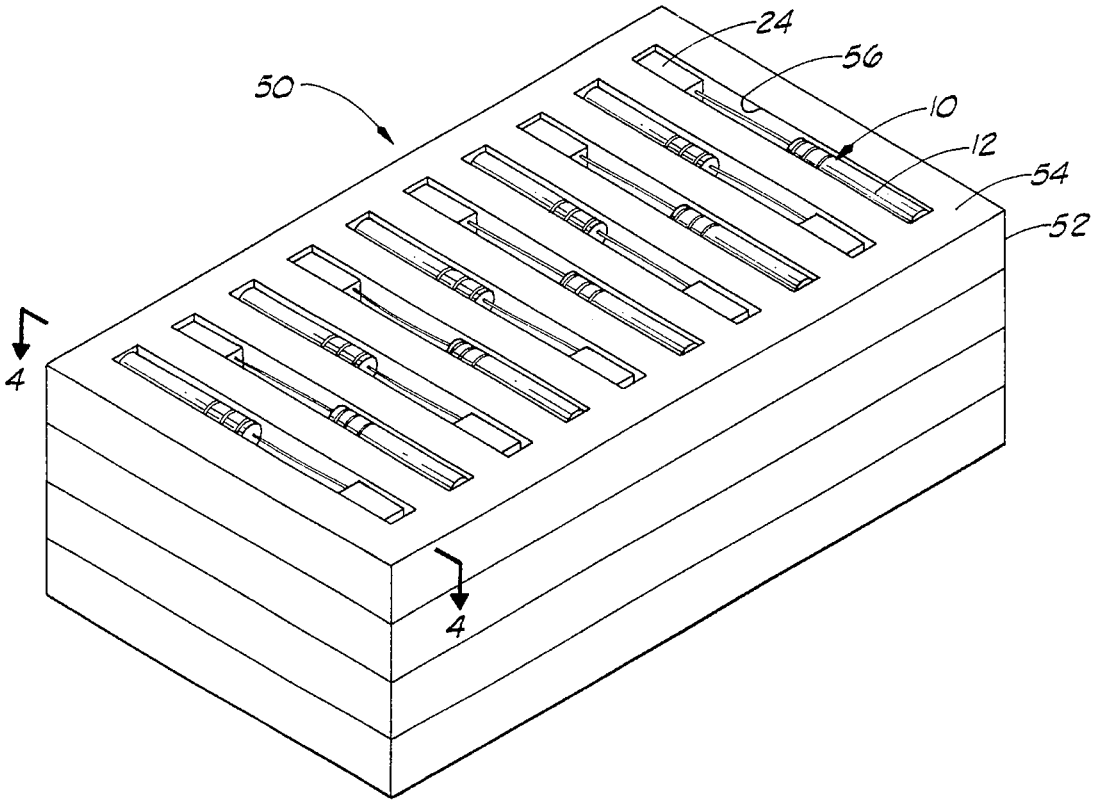
FIG. 3 is a perspective view of packaging for the detonator assemblies of the present invention comprising a plurality of stacked trays.

Attention now is directed to FIG. 3 for a description of a preferred packaging for detonator assemblies in accordance with the present invention. The packaging, designated generally by the reference numeral 50, comprises at least one tray 52, and more preferably a plurality of such trays. The tray 52 may be integrally formed of some lightweight, fireproof material such as styrofoam.

The tray 52 preferably is rectangular and has a top 54 in which a plurality of parallel elongate recesses are formed. One of the recesses is designated by the reference numeral 56. The length of the recess 56 is about the same as the length of one detonator assembly 10. The depth of the recess 56 is about the same as the width of the connector 24 of the assembly, so that the assembly will not protrude above the top 54 of the tray 52. The width of the recess 56 is sized to grippingly engage the sides of the connector 24 of the detonator assembly 10. In this way, if the tray 52 is tipped over, the detonator assemblies 10 will not spill out of the tray 52.

The recesses 56 are spaced about one-half inch apart and the detonator assemblies are positioned therein in alternating fashion. Thus, the detonator 12 of adjacent assemblies 10 will be at opposites sides of the tray 52, and the detonator of alternate assemblies 10 will be at least one inch apart.

Figure 4:
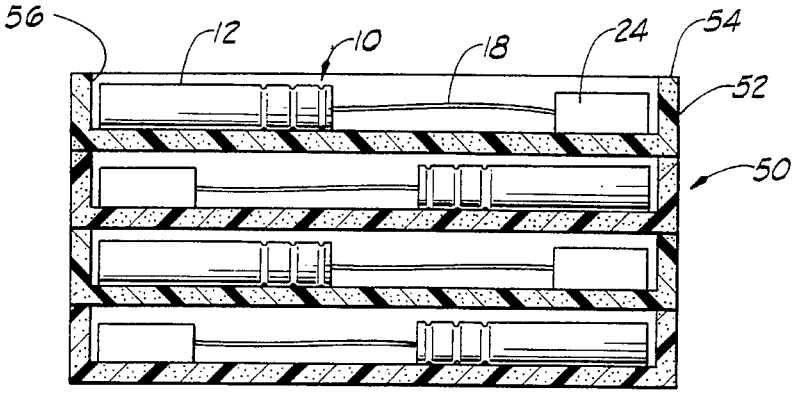
FIG. 4 is a cross-sectional view taken along line 4—4 in FIG. 3.

As shown in FIGS. 3 and 4, the package 50 includes a plurality of trays 52 stacked one upon another. Each tray 52 has a thickness of at least about one inch. Accordingly, when the trays 52 are stacked together, detonator assemblies in adjacent trays are at least one inch apart. As seen in FIG. 4, the trays 52 are loaded so that the detonator assemblies 10 at the ends of adjacent trays are arranged in alternating fashion so that the detonator ends are at opposite sides of the trays.

In the preferred practice of the present invention, each tray 52 has about 25 recesses. To simplify the illustration, however, the tray 52 is shown in the drawings as having only ten recesses. Similarly, although in the preferred commercial practice of the invention, about 10 trays will be combined in a single package, a stack of only 4 trays is depicted in the drawings. The package 50 preferably is enclosed in a transparent covering commonly known as "shrink wrap."

Changes may be made in the combination and arrangement of the various parts, elements, steps and procedures described herein without departing from the spirit and scope of the invention as defined in the following claims.

What is claimed is:

1. A package of detonator assemblies comprising:

a plurality of detonator assemblies, each one of the plurality of detonator assemblies having a first end and a second end and comprising:

an electrical detonator comprising generally the first end of the detonator assembly;

two electrical leads of equal length, each having a first end and a second end, the first end of each lead being connected to the electrical detonator; and an electrical connector connected to the second ends of the two electrical leads and characterized as capable of maintaining the second ends of the two electrical leads in a condition non-conductive to electrical charges;

at least one tray having a top; and wherein the top of the tray defines a plurality of parallel elongate recesses, each of the parallel elongate recesses being shaped to grippingly receive a single one of the plurality of detonator assemblies.

2. The package of detonator assemblies of claim 1 wherein the electrical connector is further characterized as maintaining the ends of the electrical leads in waterproof condition.

3. The package of detonator assemblies of claim 1 wherein the electrical connector is further characterized as providing a high tensile strength splicing of the two electrical leads of the assembly and another pair of similar electrical leads without the use of splicing tools.

4. The package of claim 1 wherein the plurality of detonator assemblies are arranged in alternating fashion so the first end of any one detonator assembly is not adjacent the first end of any other detonator assembly.

5. The package of claim 4 wherein the recesses in the tray are spaced about one-half inch apart so that the first ends of alternate detonator assemblies are about one inch apart.

6. The package of claim 5 comprising a plurality of trays, wherein the trays are stacked, wherein each of the trays is about one inch thick so that detonator assemblies in adjacent trays are at least about one inch apart.

7. The package of claim 5 wherein the trays are integrally formed of fire retardant material.

8. The package of claim 1 wherein the tray is integrally formed of fire retardant material.

9. A package of detonator assemblies comprising:

a plurality of detonator assemblies, each one of the plurality of detonator assemblies having a first end and a second end and comprising:

an electrical detonator comprising generally the first end of the assembly;

two electrical leads of equal length, each having a first end and a second end, the first end of each lead being connected to the electrical detonator; and an electrical connector connected to the second ends of the two electrical leads and characterized as capable of maintaining the second ends of the two electrical leads in a condition non-conductive to electrical charges, and wherein the electrical connector comprises generally the second end of the assembly;

at least one tray having a top;

wherein the top of the tray defines a plurality of parallel elongate recesses; and wherein each of the plurality of parallel elongate recesses contains one of the detonator assemblies comprising the plurality of detonator assemblies and wherein the plurality of parallel elongate recesses are spaced apart to maintain the first ends of the detonator assemblies at least one inch apart.

10. The package of detonator assemblies of claim 9 wherein the electrical connector is further characterized as maintaining the ends of the electrical leads in waterproof condition.

11. The package of detonator assemblies of claim 9 wherein the electrical connector is further characterized as providing a high tensile strength splicing of the two electrical leads of the assembly and another pair of similar electrical leads without the use of splicing tools.

12. The package of claim 9 wherein the recesses are spaced about one-half inch apart and the detonator assemblies are arranged in alternating fashion so that the first ends of adjacent detonator assemblies are at opposites sides of the tray and so that the first ends of alternate assemblies are at least about one inch apart.

13. The package of claim 12 wherein the package includes a plurality of trays, each of which is about one inch thick so that detonator assemblies in adjacent trays are at least about one inch apart.

14. The package of claim 13 wherein the trays are integrally formed of fire retardant material.

15. The package of claim 9 wherein the trays are integrally formed of fire retardant material.

16. The package of claim 9 wherein each one of the plurality of parallel elongate recesses is shaped to grippingly engage the first end of the detonator assembly contained therein.

17. A package of detonator assemblies comprising:

a plurality of detonator assemblies, each one of the plurality of detonator assemblies having a first end and a second end and comprising:

an electrical detonator comprising generally the first end of the assembly;

two electrical leads of equal length, each having a first end and a second end, the first end of each lead being connected to the electrical detonator; and an electrical connector connected to the second ends of the two electrical leads and characterized as capable of maintaining the second ends of the two electrical leads in a condition non-conductive to electrical charges, and wherein the electrical connector comprises generally the second end of the assembly;

at least one tray having a top;

wherein the top of the tray defines a plurality of parallel elongate recesses; and wherein each of the plurality of parallel elongate recesses contains one of the detonator assemblies comprising the plurality of detonator assemblies and wherein the plurality of detonator assemblies are arranged in alternating fashion so that the first ends of the adjacent detonator assemblies are at opposite sides of the tray.

18. The package of detonator assemblies of claim 17 wherein the electrical connector is further characterized as maintaining the ends of the electrical leads in waterproof condition.

19. The package of detonator assemblies of claim 17 wherein the electrical connector is further characterized as providing a high tensile strength splicing of the two electrical leads of the assembly and another pair of similar electrical leads without the use of splicing tools.

20. The package of claim 17 wherein the package comprises a plurality of trays, each of the trays being about one inch thick so that the plurality of detonator assemblies in the adjacent trays are maintained at least one inch apart.

21. The package of claim 20 wherein the trays are formed of fire retardant material.

22. The package of claim 17 wherein the tray is formed of fire retardant material.

* * * * *

UNITED STATES PATENT AND TRADEMARK OFFICE

CERTIFICATE OF CORRECTION

PATENT NO. : 5,585,591

DATED : December 17, 1996

INVENTOR(S) : Kevin H. Waldock

It is certified that error appears in the above-indentified patent and that said Letters Patent is hereby corrected as shown below:

On the Title Page, under FOREIGN PATENT DOCUMENTS, change the date of the reference United Kingdom Patent No. 15703, from "of 1895" to --7/1895--.

Column 3, line 51, change "seconds" to --second--.
Column 3, line 61, change "20" to --28--.
Column 4, line 15, change "taught" to --taut--.

Signed and Sealed this

Eighteenth Day of March, 1997

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,585,591

DATED : December 17, 1996

INVENTOR(S) : Kevin H. Waldock

It is certified that error appears in the above-indentified patent and that said Letters Patent is hereby corrected as shown below:

In the drawings, Sheet 1, Figure 2, relocate the lead line for reference number 42 to terminate at the second end 28 of the electrical connector 24, as shown below:

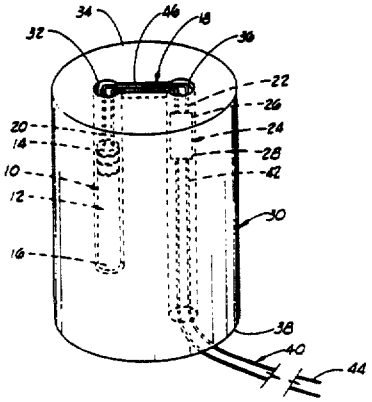

FIG. 2